US010403065B2

(12) United States Patent
Gigl et al.

(10) Patent No.: US 10,403,065 B2
(45) Date of Patent: Sep. 3, 2019

(54) METHOD AND DEVICE FOR ISSUING AN ACCESS AUTHORIZATION

(71) Applicant: Maxim Integrated Products, Inc., San Jose, CA (US)

(72) Inventors: Thomas Gigl, Graz (AT); Gerhard Schultes, Unterpremstatten (AT)

(73) Assignee: Maxim Integrated Products, Inc., San Jose, CA (US)

( * ) Notice: Subject to any disclaimer, the term of this patent is extended or adjusted under 35 U.S.C. 154(b) by 111 days.

(21) Appl. No.: 14/776,897

(22) PCT Filed: Mar. 13, 2014

(86) PCT No.: PCT/EP2014/054972
§ 371 (c)(1),
(2) Date: Sep. 15, 2015

(87) PCT Pub. No.: WO2014/140185
PCT Pub. Date: Sep. 18, 2014

(65) Prior Publication Data

US 2016/0027226 A1 Jan. 28, 2016

Related U.S. Application Data

(60) Provisional application No. 61/789,787, filed on Mar. 15, 2013.

(30) Foreign Application Priority Data

Feb. 21, 2014 (DE) ..... 10 2014 102 271

(51) Int. Cl.
*G07C 9/00* (2006.01)

(52) U.S. Cl.
CPC ..... *G07C 9/00111* (2013.01); *G07C 9/00309* (2013.01); *G07C 2009/0096* (2013.01);
(Continued)

(58) Field of Classification Search
CPC ..... G07C 9/00111
See application file for complete search history.

(56) References Cited

U.S. PATENT DOCUMENTS

2001/0033222 A1 10/2001 Nowottnick et al.
2003/0119453 A1 6/2003 Blatz et al.
(Continued)

FOREIGN PATENT DOCUMENTS

DE 19850176 C1 8/2000
EP 1972511 A1 3/2007
EP 1972511 A1 9/2008

OTHER PUBLICATIONS

International Search Report dated Jun. 25, 2014, in corresponding International Application No. PCT/EP2014/054972, filed Mar. 13, 2014 (4pgs).

(Continued)

*Primary Examiner* — Nabil H Syed
(74) *Attorney, Agent, or Firm* — North Weber & Baugh LLP

(57) ABSTRACT

Presented are methods and devices for issuing an authorization for access to a secured area, particularly a building, a room, a vehicle, a computer system or the like, or for starting a machine, a vehicle, a computer or the like, having a monitoring unit comprising a transmitter, a receiver, and an evaluation device, and having a key, a key card or similar, referred to as a key in short below, having a transmitter, a receiver and an electronic device. A permissible position and/or a permissible distance between the transmitter of the monitoring unit and a permissible key is determined prior to issuing an authorization, wherein the transmitter of the monitoring unit transmits signals and the key transmits response signals back to the monitoring unit. The permissible position and/or the permissible distance of the key are
(Continued)

Figure 1:
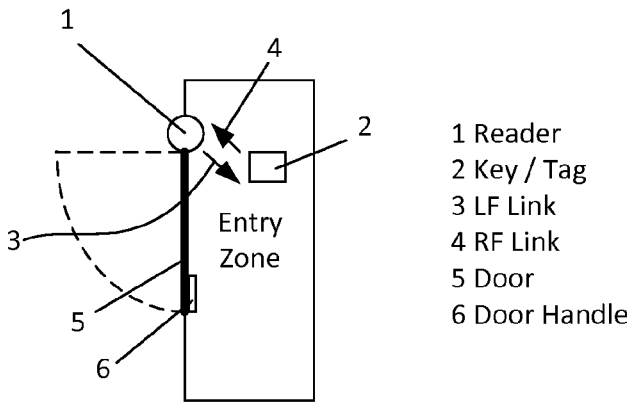

determined from the signals received by the key, wherein a signal strength of said signals is evaluated in various directions and/or angles.

19 Claims, 4 Drawing Sheets

(52) U.S. Cl.
CPC ..... *G07C 2009/00555* (2013.01); *G07C 2209/63* (2013.01)

(56) References Cited

U.S. PATENT DOCUMENTS

2007/0168127 A1* 7/2007 Zaruba ..... A61B 5/053 701/500
2009/0179742 A1* 7/2009 Takeshima ..... G01V 15/00 340/10.1
2009/0315682 A1* 12/2009 Leconte ..... G07C 9/00309 340/10.1
2011/0148569 A1* 6/2011 Froitzheim ..... B60R 25/24 340/5.7
2011/0148573 A1* 6/2011 Ghabra ..... B60R 25/245 340/5.61
2013/0162395 A1* 6/2013 Akbari-Dilmaghani ..... G05B 1/01 340/5.61

OTHER PUBLICATIONS

Written Opinion dated Jun. 25, 2014, in corresponding International Application No. PCT/EP2014/054972, filed Mar. 13, 2014 (5pgs).
Office Action dated Jan. 4, 2017, in Chinese Patent Application No. 201480015773.5 (25 pgs).
Office Action dated Sep. 5, 2017, in Chinese Patent Application No. 201480015773.5 (14pgs).
Office Action dated Apr. 2, 2018, in Chinese Patent Application No. 201480015773.5 (19pgs).
Response filed Jun. 19, 2018, and English translation of marked-up claims, in Chinese Patent Application No. 201480015773.5 (9pgs).
Office Action dated Oct. 22, 2018, in Chinese Patent Application No. 201480015773.5 (22pgs).

* cited by examiner

METHOD AND DEVICE FOR ISSUING AN ACCESS AUTHORIZATION

The present disclosure relates to a method for issuing an authorization for access to a secured area, particularly in a building, a room, a vehicle, a computer system, or the like, or for starting a machine, a vehicle, a computer, or the like, having a monitoring unit comprising a transmitter, receiver, and evaluation device, and having a key comprising a transmitter, receiver, and electronic device, wherein a permissible position and/or a permissible distance between the transmitter of the monitoring unit and a permissible key is captured for issuing an authorization, wherein the transmitter of the monitoring unit transmits signals and the key transmits response signals back to the monitoring unit. The disclosure further relates to a corresponding device having a monitoring unit and key, and a monitoring unit and a key for use in a corresponding device.

Recently passive keyless entry systems became very popular for the access of secure areas, smart homes, and vehicles. The advantage of such systems is that the user does not need to take interaction with the key by pressing its buttons. This means it is sufficient that the user is close to the reader inside an entry zone and he takes the key inside its pockets (see FIG. 1). Typically the key is detected and authenticated via a low frequency (LF) link from the reader to the key and a radio frequency (RF) link from the key to the reader. The low frequency (LF) radio link is used to limit the operating distance from the reader to the key that the user has to be close to the reader.

Connectivity is usually not sufficient for a reliable detection of the proximity of the key. The proximity is very important for security issues, e.g. that the door only opens if a person is in front of it. Also very simple attacks can be applied to such systems, e.g. the relay attack. A relay attack can unlock the doors even if the key is far away from the reader. At a relay attack two antennas are placed between the reader and the key. One antenna is placed close to the reader and the other one is placed close to the key. The signals from the key and/or the reader are basically only forwarded and so the car believes the key is close to it even if the key is far away. Thus a high level encryption does also not provide better security.

Thus localization algorithms can be used to verify if the key is really close. Typical approaches are based on ranging and localization based on time measurements, time difference of arrival, angle of arrival, or power measurements. Time difference and time of arrival typically needs highly accurate timing and synchronization to get reliable and accurate ranging and localization results. Furthermore, these systems typically need very wide bandwidth signals, which are realized with complex and expensive hardware. Additional in angle of arrival complex antenna systems or arrays are necessary. Finally ranging or localization based on received power is very simple but shows weak performance in the sense of reliability and accuracy.

A potential object of the present disclosure is to avoid existing disadvantages of the prior art.

The object is achieved by a device having a monitoring unit and key, and a monitoring unit and a key for use in a corresponding device having single or a plurality of features of the present disclosure.

According to the disclosure, the method for issuing an authorization for access to a secured area, particularly in a building, a room, a vehicle, a computer system, or the like, or for starting a machine, a vehicle, a computer, or the like, a monitoring unit comprising a transmitter, receiver, and evaluation system, and a key, comprising a transmitter, receiver, and electronic device. For an authorization to be issued, a permissible position and/or a permissible distance from the transmitter of the monitoring unit to a permissible key is captured, wherein the transmitter of the monitoring unit transmits signals and the key transmits response signals to the monitoring unit. The permissible position and/or permissible distance of the key are determined from the signals of the transmitter received by the key, wherein a signal strength of said signals is evaluated in various directions and/or angles.

The method according to the disclosure can be used to determine the location of the key relative to the monitoring unit, and to check whether it is plausible. This prevents manipulations that could be used to gain unauthorized access to the secured area. Access is issued only if the signal strength in the individual directions and/or angles corresponds to an expected, predetermined signal strength.

The term "key" means not only a key in the conventional sense, such as a car key or a front door key, but also very general devices that are being checked in order to allow access. It can thus be a card, for example, or a device or vehicle that must be introduced to the secured area.

Monitoring unit means a unit which may be able to receive the signals from the key and/or which controls the permissible position and distance and/or which monitors, whether a key is coming into a permissible position and/or distance and/or is moving within a permissible position and/or distance.

In an advantageous embodiment of the method according to the disclosure, the signal strength of the transmitter signals received by the key is analyzed absolutely or relative to each other in one and/or various direction(s) and/or absolutely or relative to each other at one and/or various angle(s).

It is particularly advantageous if the transmitter of the monitoring unit and of the key transmit in the LF range and/or in the RF range, preferably the transmitter of the monitoring unit in the LF range and the transmitter of the key in the RF range. The transmitted signals of the LF range extend less far than the transmitted signals of the RF range. Due to the greater effort of generating LF transmitted signals, it is typically particularly advantageous if the LF transmitted signals are generated by the stationary part of the device; that is, the monitoring unit, and the RF transmitted signals are generated by the portable, small, and more handy part; that is, the key. If, however, the key is a vehicle, for example, said vehicle can also generate LF transmitted signals.

It is further advantageous if the permissible position and/or the permissible distance are determined by means of a plurality of transmitters, respectively antennas of the monitoring unit. The position and the distance of the key from the monitoring unit can thus be determined more precisely. Security against manipulation is also further improved.

It is also advantageous if the signals received by the key, particularly LF signals, are analyzed with respect to their vectors of the magnetic field strengths. The electrical field strengths of the signals transmitted by the transmitter of the monitoring unit and received by the receiver of the key can be simply captured and analyzed.

It is advantageous if the signals, received by the key, are evaluated in respect of their direction of penetration through the magnetic field of one or more coils.

In a further advantageous embodiment of the invention, the polarization of the signals is evaluated.

If the signals, received by the key, are evaluated in respect of the relative direction of penetration of the magnetic field of of several coils, the direction may be determined very exactly.

It is particularly advantageous if the analysis is done by means of a fingerprinting algorithm comparing the received signal strengths to the expected signal strengths in the permitted access area and allowing access if the probability of a valid position is above a certain threshold value. This concept is very new and inventive.

One approach is based on LF fingerprinting with respect to the field components in different directions or angles in combination with the analysis of the gravity vector. This has the advantage that no additional RF link or complex hardware is required. The field components are measured in x, y, and z-directions and are compared to the expected field characteristics in the entry zone of the building or vehicle. Additional to this a g-vector may be taken into account to find the orientation of the key and thus leads to more unique results and better security.

It is also advantageous if the distances and/or the permitted access areas are subdivided into a plurality of sub-areas, of which at least two, preferably all, must be detected for an authorization in the distance measurement/position detection during a periodic check. It is also advantageous if a particular sequence of sub-areas must be detected. An approach of the key to the monitoring unit can thereby be detected, for example, corresponding as a rule to the expected actual sequence when "unlocking" the secured area.

It is also extremely advantageous if the received field strengths to be expected are determined by means of calibration measurements. Prior to the first use of the key, for example, it is thereby determined how the signal characteristics are at particularly distances or positions in the various directions or angles. If the key is then later, during regular use, held in a particular orientation, then the distance and/or the position of the key can be compared by a comparison of the target signal characteristics from the calibration and the actual signal characteristics, and allow opening the secured area if they match within a permissible tolerance.

It is also advantageous to calibrate the transmitted signals at the start of commissioning and/or at predetermined intervals. The reliability can thereby be increased and errors in detecting the key can be avoided.

It is further advantageous if the current characteristics of the transmitted signals of the monitoring unit is captured and compared with the current characteristics of the calibrated values for correcting the received transmitted signals. It is thus ensured that the transmitted signal is detected correctly even in case of the current characteristics, e.g. strength of the transmitted signal deviating from the calibration measurement.

It is particularly advantageous if, in addition to the vectors of the signal strengths or other characteristics, a gravitation vector of the monitoring unit and/or the key is evaluated for the authorization. If the monitoring unit and/or the key is used after moving or rotating in comparison with the calibration measurement, then this can be detected by means of the gravitation vector and corrected with respect to the calibration measurement, so that the expected target signals match the corrected actual signals.

A gravitation vector of the monitoring unit and/or the key is evaluated for the orientation of the key in the area and/or to the monitoring unit.

It is particularly advantageous if a plurality of distance measurements and/or position queries of the transmitter(s) are performed before the authorization is issued. Even greater security relative to unauthorized entry is thereby obtained.

It is further advantageous if, based on the signal strength analysis, a tracking algorithm is used that performs tracking of the key within a particular distance and/or a particular environment of the access system. Security is increased if, in addition, access is permitted only at a previously determined position or an area in which the key is present, or by means of an interrupt, e.g. by actuating a door handle. The estimated current position is thereby compared with a valid position by a tracking algorithm and, if there is a match, or if a match is at least sufficiently probable and/or a realistic trajectory for opening the secured area can be established, then the access is authorized.

It is further advantageous if an analysis of the gravitation vector reflects the expected motion of the monitoring unit and/or the key. The real approach of the key to a vehicle, for example, can thereby be determined and an attempt to defraud, as for example repeated attempts to obtain access authorization by means of a counterfeit key in the vicinity of the vehicle may be detected.

It is particularly advantageous if, in addition to the distance and/or position measurement, a contact location of the monitoring unit, particularly a handle or a button, must be contacted within a specified period of time. It is thus avoided that, for example, the vehicle is opened by means of the key solely by the approach of the key, without there being any intent to actually open the vehicle. If the contact point is not contacted, then the system locks itself again.

It is further advantageous if the authorization is issued only if at least a plurality, preferably all of the transmitted signals are checked to comply more or less with the expected values and thus are detected as correct or at least within a specified tolerance range.

It is further advantageous if the electronic device of the key determines and analyzes the vectors of the signals of at least one transmitter received by the key. Said signals respectively vectors, thus analyzed, can then be transmitted to the monitoring unit for further checking by means of a transmitter in the key. It is also advantageous if the key transmits the received signals respectively vectors back to the monitoring unit, which then analyzes the vectors.

It is further advantageous if a query takes place between the monitoring unit and the electronic device of the key in order to check the permissibility of the key. It is thus avoided that an invalid key is used to attempt to have an access authorization issued. The query between the monitoring unit and the electronic device of the key takes place, for example, such that a query is sent to the key and the key sends back a permissible response.

A device according to the disclosure for issuing an authorization for access to a secured area, particularly in a building, a room, a vehicle, a computer system, or the like, or for starting a machine, a vehicle, a computer, or the like, is equipped with a monitoring unit comprising a transmitter, receiver, and evaluation system, and a key comprising a transmitter, receiver, and/or electronic device. A permissible distance of a permissible key is captured by a transmitter of the secured area for an authorization. The transmitter of the monitoring unit transmits signals and the key transmits response signals back to the monitoring unit. In order to determine the permissible position and/or the permissible distance and/or the permissible range of the key from the transmitter of the monitoring unit, the key comprises a device for capturing vectors of the signal strengths of the signals of the transmitter received by the key in various directions and/or at various angles. By subdividing the signal into the various directional vectors, such as in a Cartesian coordinate system and/or at particularly angles to each other, the signal is broken down into individual components and can thus be analyzed in more detail than only using the total received signal strength. The security of the system is thus significantly increased.

It is also extremely advantageous if the monitoring unit and/or the key comprise a—particularly three-dimensional—acceleration sensor and/or gyroscope. The position and motion of the monitoring unit and/or the key can thereby be captured. The gyroscope may be used to adjust or correct the measurement signals concerning specific movements of the acceleration sensor.

It is self-understanding that each transmitter and each key includes at least one antenna to transmit and/or receive the respective signals.

It is further advantageous if a device is provided for calculating a fingerprinting algorithm. The captured signal or the captured components of the signal are thereby compared with target signals that would have been expected. An access authorization is issued only if an actual signal is present at least within a permissible tolerance range.

It is particularly advantageous if the transmitter of the monitoring unit and of the key comprise devices for transmitting in the LF range and/or the RF range. It is typically provided thereby that the monitoring unit transmits in the LF range (low frequency) and the key transmits in the RF range (radio frequency).

It is further advantageous if a database is provided for storing the calibrated/expected data in each of the valid positions and/or valid distances. The comparison of the target values with the actual values is thereby particularly simple to perform.

It is further advantageous if the monitoring unit comprises a contact point, particularly a handle or a button. The lock opens only after said contact point, particularly within and/or for a specified period of time, is touched or tripped, for example, or alternatively the opened lock is locked again if the contact point is not touched.

It is further advantageous if the monitoring unit comprises a current measurement device for measuring the current strength of the transmitted signal. A comparison of the target values with the actual values is thus better able to be implemented if the current strength in the calibration measurement does not match the current strength of the actual transmitted signals.

It is further advantageous if the monitoring unit and/or the key comprise a device for detecting the permissibility of the key. The use of non-permissible keys is thereby made impossible.

A further advantage is if the monitoring unit and/or the key disclose a unit for determining the penetration direction of the magnetic field or the relative penetration direction of the magnetic field between two coils.

The present invention further concerns a monitoring unit and a key which are provided to be used together with a respective device and a respective method.

Figure 2:
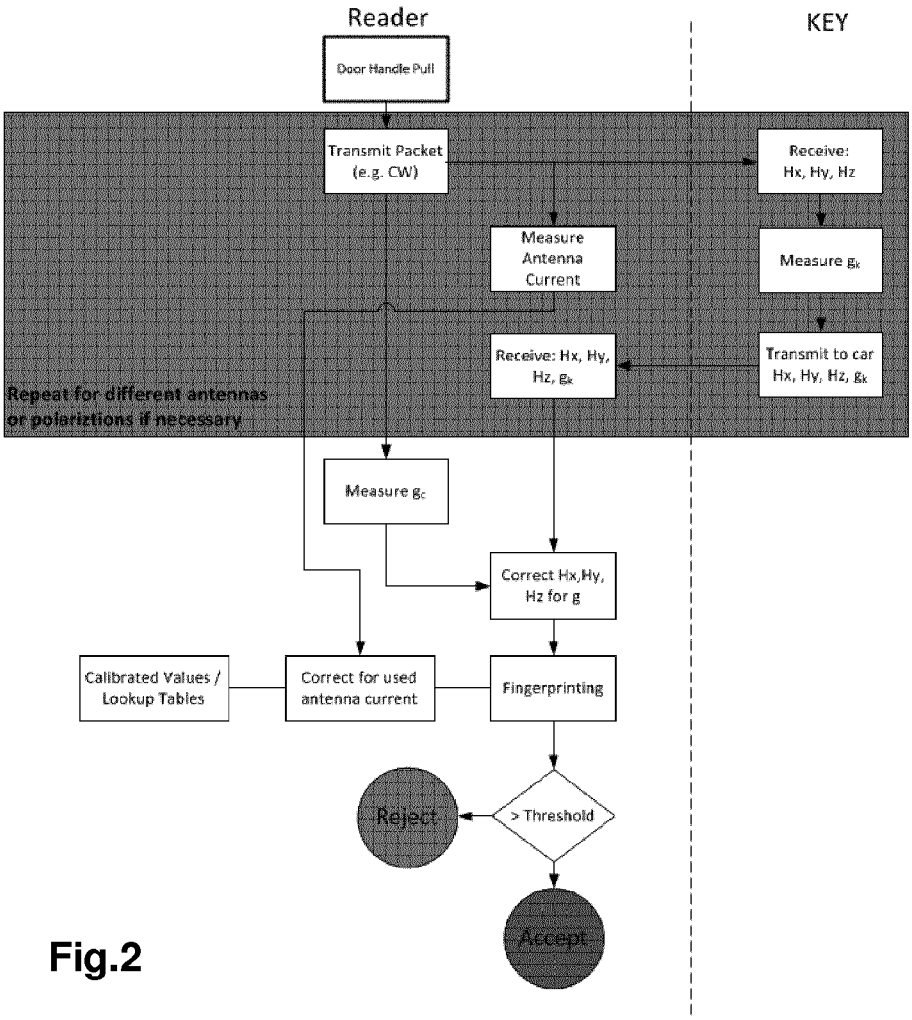
Figure 3:
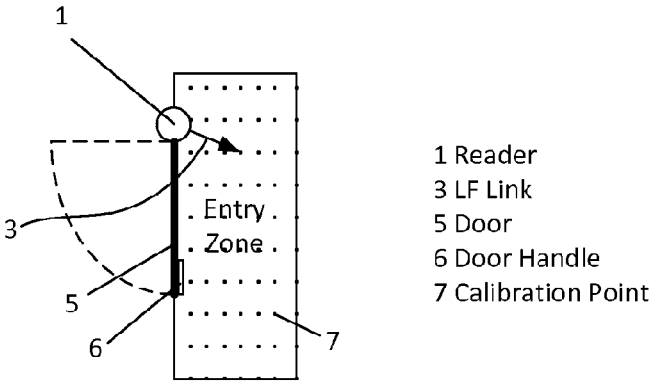
Figure 4:
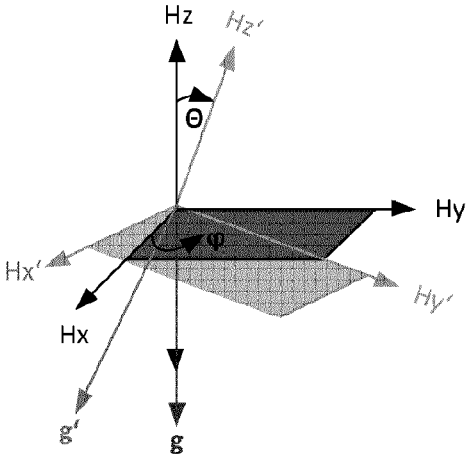
Figure 5:
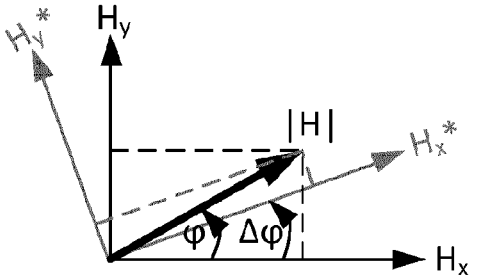
Figure 6:
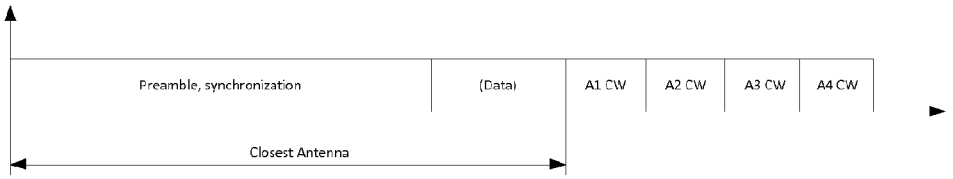
Figure 7:
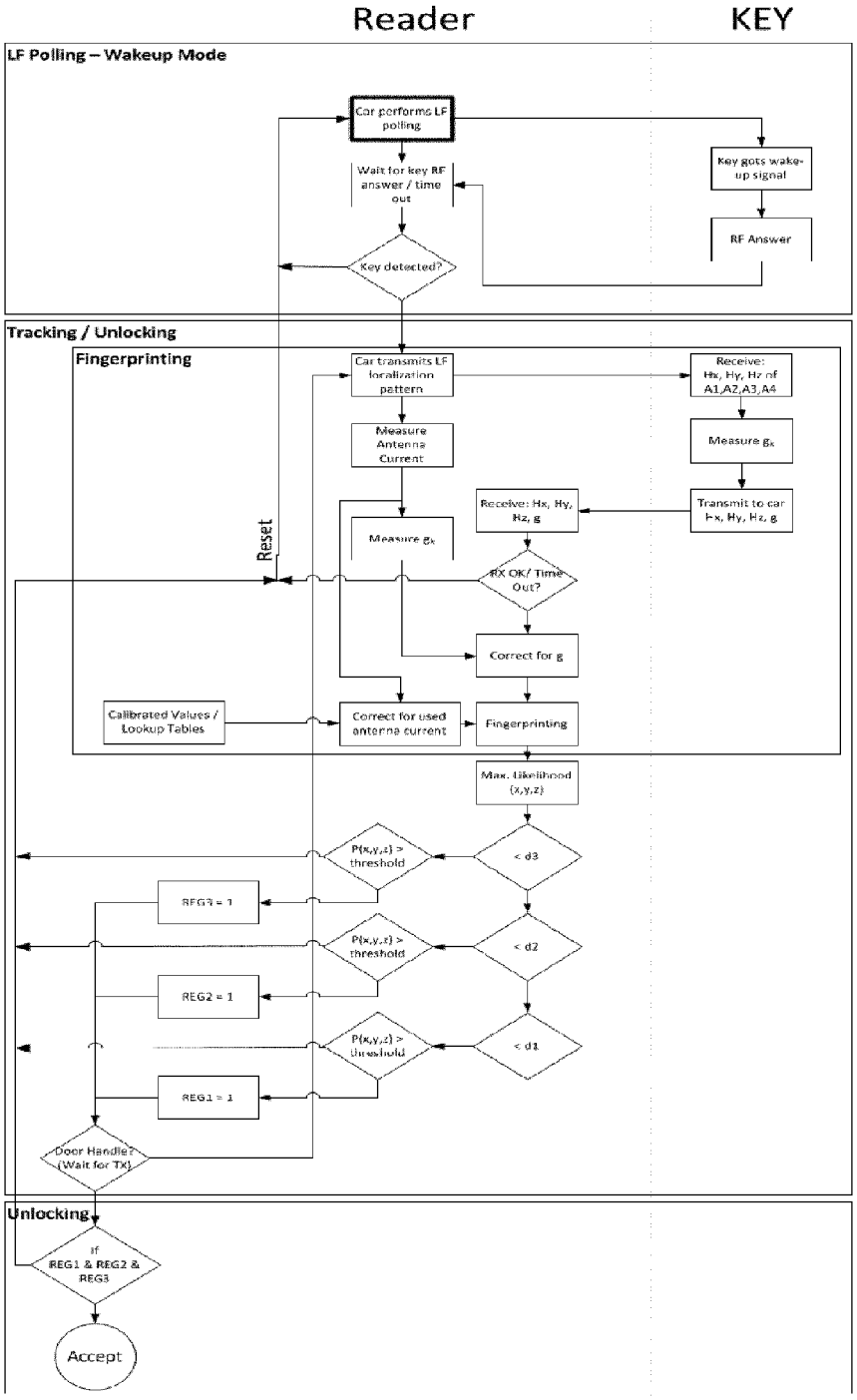

Further advantages of the invention are described in the following implementation examples. Shown are:

FIG. 1 Principle drawing of a passive keyless entry system;

FIG. 2 Fingerprinting concept for multiple transmitter antennas;

FIG. 3 Example for calibration measurements;

FIG. 4 Correction of the coordinate system with gravitation vector, H coordinates system of the calibration measurements, H' coordinates of the key;

FIG. 5 Coordinates transform for angle φ;

FIG. 6 LF fingerprinting packet;

FIG. 7 Flow chart of tracking algorithm; and

Figure 8:
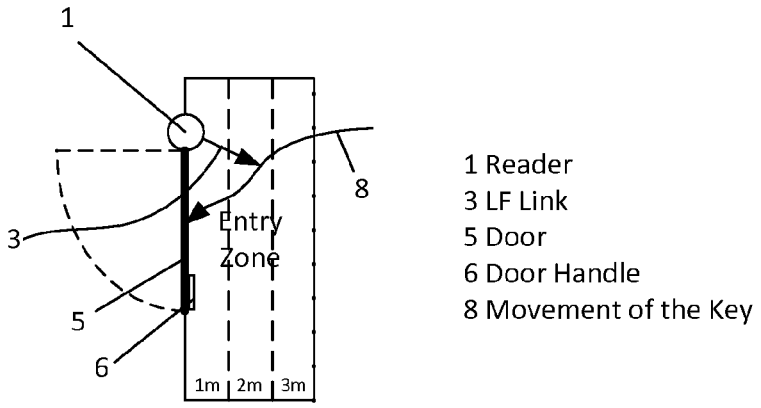

FIG. 8 Principle of tracking.

FIG. 2 discloses one of several possible disclosed embodiments of a concept of LF RSS Fingerprinting using magnetic field components $H_x$, $H_y$, and $H_z$. The reader transmits a continuous wave (CW) signal via the low frequency (LF) link to the key. Also other signal designs are possible, it is only necessary that the key can measure the received signal strength of the received LF signal. Generally it is also possible that the signal is a radio frequency (RF) signal. The current in the transmission needs to be known and is measured during the transmission. The current can be also measured before or behind the transmission. If it is ensured that the current is the same as it was during calibration measurement, the current does not have to be measured.

The key measures the magnetic field components $H_x$, $H_y$, and $H_z$. In a preferred embodiment of the disclosure, the gravitation vector $g_k$ is measured by a 3D accelerometer. Then the key transmits the measured parameters back to the car via the RF link. Also a LF link is possible. If several antennas are used, the control unit switches to the next antenna (or polarization) and the procedure is repeated until all relevant antennas or polarizations have been measured. A packet design where these steps could be done within one packet is shown in FIG. 8. Meanwhile the control unit, respectively a reader of the control unit measures also its gravitation vector $g_c$—only necessary if the reader can move—and the measured field vectors get tilted by the vectors $g_k$ and $g_c$. By doing this the measurement vectors and the calibration vectors are in the same plane.

The calibration measurements have been measured with a specific current, which is not necessarily the same as in the real application. In this case, the current needs to be measured and the calibration measurements are corrected to the transmit current. After that a finger printing algorithm based on the field strengths estimates the probabilities for a valid position in the entry zone. If the probability is above a specific value the car accepts the signal as a valid response.

Thus an attacker needs to ensure that the key receives exactly the same power vector as the key would receive in the real location. This is a difficult task because very careful positioning of the attacker to the key is necessary. Due to the gravitation vector the key knows its orientation to the horizontal plane, which the attacker does most probably not known. Even if the attacker sees the key, it is difficult to create the exact power levels in the key and find an appropriate orientation to the key.

FIG. 3 shows an example for calibration measurements. The finger printing algorithm needs a calibration for the received field strengths in the entry zone in front of the reader. Therefore the received field strengths $H_x$, $H_y$, and $H_z$ in x, y, and z direction needs to be measured by a calibrated key for each predetermined location in the entry zone. The output power of all LF TX antennas needs to be calibrated. These field strengths $H_x$, $H_y$, and $H_z$ are the values which are expected when later the key is at the same position resp. calibration point in front of the reader.

The outcome of the calibration are the mean field strengths per position in x, y, and z directions $\overline{H}=[\overline{H}_x, \overline{H}_y, \overline{H}_z]$. Usually also the variances of the measurements are taken for the fingerprinting $\sigma_x^2$, $\sigma_y^2$, $\sigma_z^2$. These values are typically stored within a lookup table.

The probability P for the finger printing algorithm for location k and φ works according to an algorithm using the Gaussian probability density function (PDF), the field strength vector $\overline{H}(k, \varphi)$ as the calibrated values at location k with the angle φ, and the measured field strengths H. A transmission from more than one antenna or polarization leads to improved security. Thus the equation can be rewritten for the total probability over all relevant antennas by $$P_{total}(k, \varphi) = \prod_{i=1}^{M} P_{k,\varphi,i}(H_x, H_y, H_z \mid \overline{H}(k, \varphi)) \geq \gamma$$

where M is the number of relevant antennas and γ is the acceptance probability (threshold). If one probability of an allowed location in the entry zone is higher than the threshold, access is guaranteed.

FIG. 4 shows the correction of the coordinate system with the gravitation vector. H is the coordinates system of the calibration measurements, H' is the coordinates system of the key or the car resp. control unit. If a gravitation vector for correction of the key or the car resp. control unit coordinate system is used, the measurement vector H' may be corrected by the gravitation vector g', that the coordinate system of the key matches the plane of the calibration measurements H (see FIG. 4). The gravitation vector is measured for example by a 3D accelerometer. Therefore the coordinate system is tilted to Θ=180° for g or in other words the correction for Θ=0 between Hz and Hz'.

The handling of the unknown vector φ is required for the usage of more than one antenna. FIG. 5 shows coordinates transform for angle φ.

The coordinate transform can be applied to the calibration measurements or to the measured vector.

Alternatively a RSS Fingerprinting Method using the absolute value of the horizontal plane $\overline{H}_r(k)=\sqrt{\overline{H}_x^2(k)+\overline{H}_y^2(k)}$. and $H_z$ is disclosed in the following. This method shows less complexity than the fingerprinting method using $H_x$, $H_y$, and $H_z$, but losses the information regarding φ in the horizontal plane. A possibility to send only one fingerprinting packet with continuous wave signals from different antennas is shown in FIG. 6. First a preamble is transmitted including the synchronization part. Next some optional data can be transmitted. Both blocks are transmitted e.g. from the closest antenna, which has the strongest signal. In the next blocks continuous wave signals are transmitted from different antennas. During these blocks the key measures the received signal strength for the finger printing.

The sensitivity can be increased with tracking algorithms. In contrast to a common tracking algorithm that wants to track the most probable location, we want to ensure that the device was on valid positions within a specific radius to the reader. That prevents the trying of different angles of an attacker to find a valid one to open the car. This means for each test the attacker needs to follow a path to the reader. This costs a lot of time and increases the risk for the attacks significantly. This "Tracking" of the key is shown in the flow chart of tracking algorithm according to FIG. 7.

First the reader is in an LF polling mode, where the reader sends a wake up signal continuously. Then the reader waits for a specific time or until the key answers via an RF link. If a key is detected the car starts the signaling for the localization/fingerprinting.

The car transmits a fingerprinting packet (see e.g. FIG. 6) or a continuous wave signal via the low frequency (LF) link to the key. The current in the transmission needs to be known and is according to this embodiment measured during the transmission. The current can be also measured before or behind the transmission. The key measures the magnetic field components $H_x$, $H_y$, and $H_z$ for all relevant antennas.

The gravitation vector g is measured by a 3D accelerometer. Then the key transmits the measured parameters back to the reader via the RF link. The reader measures also its gravitation vector $g_c$ and the measured field vectors get tilted according to it and the key gravitation vector $g_k$. This is done that the measurement vectors and the calibration vectors are in the same plane. The calibration measurements have been measured with a specific current, which is not necessarily the same as in the real application. Thus, the current is measured and the calibration measurements are corrected to the current situation.

The entry zone is divided into sub-zones (see FIG. 8) with a distance between 2 (d2) and 3 meters (d3), between 1 (d1) and 2 meters (d2) and a zone between 0 and 1 meter (d1).

After that a finger printing algorithm looks for the most probable location. If the most probable location is smaller than distance d3 and greater than d2 and its probability is above a specific threshold register 3 (REG3) is set. Next the door handle gets checked; if it is not pulled then the fingerprinting procedure is repeated. The repetition is also aborted if a not valid position is detected. This ensures that in the entry zone only valid positions are detected. If a reset is activated REG1 to REG3 is set to 0. If the door handle is now pulled it is checked if all registers are activated. This ensures that the person was on valid positions in all sub zones of the entry zone.

$$\text{Open} = \begin{cases} 1 & \text{if all } P_{total}(n) \geq \gamma \\ 0 & \text{else} \end{cases}$$

Another type of implementation is that not only the most possible location activates the registers of the sub zones, but also each location above the acceptance value. A reset is activated if no location in the entry zone is likely enough.

It is also disclosed a principle of tracking with an advanced movement analysis. During the tracking additional the g-vector is analyzed. It is verified if the movement is observed in the acceleration—that means if the key moves, the acceleration will change. If the position varies significantly and nothing changes in the acceleration vector, then there is something wrong and the request is rejected. Thus, it is not possible to open the car during tracking if the key is on a fixed position, e.g. in a bag in a chair or in a jacket in a wardrobe.

Keywords of the disclosure are as follows:

A method for access control to a building, a vehicle, a secure area, a computer system, or similar at which the proximity of the key for the access is verified by a finger printing algorithm based on the field strengths of low frequency radio signals in different directions and/or angles using one or more transmit antennas.

A method for access control for the starting and control of a machine (e.g. vehicle, computer), at which the proximity for the access is verified by a finger printing algorithm based on the field strengths of low frequency radio signals in different directions and/or angles using one or more transmit antennas.

Additional to the field vectors also the gravity vector may be taken into account to obtain the orientation of the reader and/or the key to relate the measured field strengths to the calibration measurements using coordinate system transformations.

The position of the key is tracked within an entry/access zone, and access is only guaranteed if all positions are above a specific probability threshold.

The proximity is tracked within an entry/access zone, and access is only guaranteed if the key/tag has successfully passed all predefined subzones.

The proximity is tracked within an entry/access zone, and access is only guaranteed if all positions are above a specific probability threshold.

The proximity is tracked within an entry/access zone, and access is only guaranteed if the key/tag has successfully passed all predefined subzones.

The gravity vector is analyzed for movement of the mobile device and access is only guaranteed if the movement and the acceleration are matching.

A method for issuing an authorization for access to a secured area, particularly in a building, a room, a vehicle, a computer system, or the like, or for starting a machine, a vehicle, a computer, or the like, by means of a monitoring unit comprising a transmitter, receiver, and evaluation system, and a key comprising a transmitter, receiver, and electronic device.

For an authorization to be issued, a permissible position and/or a permissible distance from the transmitter of the monitoring unit to a permissible key is captured.

The transmitter of the monitoring unit transmits signals and the key transmits response signals back to the monitoring unit.

The permissible position and/or permissible distance of the key are determined from the signals of the transmitter received by the key.

A signal strength of said signals is evaluated in various directions and/or angles.

The signal strength of the transmitter signals received by the key is evaluated absolutely or relatively to each other in various directions and/or angles.

The transmitters of the monitoring unit and of the key transmit in the LF range and/or in the RF range, wherein preferably the transmitter of the monitoring unit transmits in the LF range and the transmitter of the key transmits in the RF range.

The permissible position and/or the distance from the area to be secured is determined by means of a plurality of transmitters of the monitoring unit.

The signals received by the key are analyzed with respect to their vectors of the magnetic field strength.

The analysis is done by means of a fingerprinting algorithm comparing the received signal strengths to the expected signal strengths in the permitted access area and allowing access if the probability of a valid position is above a certain threshold value.

The distances and/or the permitted access areas are subdivided into a plurality of sub-areas, of which at least two, preferably all, must be detected for an authorization in the distance measurement/position detection during a periodic check.

The received field strengths to be expected are determined by means of calibration measurements.

The transmitted signals are calibrated at the start of commissioning and/or at predetermined intervals.

The current strength of the transmitted signals of the monitoring unit is captured and compared with the current strength of the calibrated values for correcting the received transmitted signals.

In addition to the vectors of the signal strengths, a gravitation vector of the monitoring unit and/or the key is evaluated for the authorization.

A plurality of distance measurements and/or position queries of the transmitter(s) are performed before the authorization is issued.

Based on the signal strength analysis, a tracking algorithm is used that performs tracking of the key within a particular distance and/or a particular environment of the access system, and access is authorized at a previously determined position/area or by means of an interrupt, e.g. the actuation of a door handle, if the estimated current position from the tracking algorithm matches a valid position or is at least sufficiently probable, and/or a realistic trajectory for opening the secured area can be established.

An analysis of the gravitation vector reflects the expected motion of the monitoring unit and/or of the key.

In addition to the distance and/or position measurement, a contact location of the monitoring unit, particularly a handle or a button, must be contacted within a specified period of time.

The authorization is issued only if at least a plurality, preferably all of the transmitted signals and checks are detected as correct or at least within a specified tolerance range.

The electronic device of the key determines and analyzes the vectors of the signals of the transmitter received by the key.

A query takes place between the monitoring unit and the electronic device of the key in order to check the permissibility of the key.

A device for issuing an authorization for access to a secured area, particularly in a building, a room, a vehicle, a computer system, or the like, or for starting a machine, a vehicle, a computer, or the like, having a monitoring unit comprising a transmitter, receiver, and evaluation device, and having a key comprising a transmitter, receiver, and electronic device, wherein a permissible distance between the transmitter of the monitoring unit and a permissible key is captured for issuing an authorization, wherein the transmitter of the monitoring unit transmits signals and the key transmits response signals back to the monitoring unit.

In order to determine the permissible position and/or the permissible distance of the key from the transmitter of the monitoring unit, the key comprises a device for capturing vectors of the signal strengths of the signals of the transmitter received by the key in various directions and/or at various angles.

The monitoring unit and/or the key comprise a particularly three-dimensional acceleration sensor.

A device can be provided for calculating a fingerprinting algorithm.

The transmitters of the monitoring unit and of the key comprise devices for transmitting in the LF range and/or the RF range.

A database is provided for storing the calibrated/expected data in each of the valid positions and/or valid distances.

The monitoring unit comprises a contact point, particularly a handle or a button.

The monitoring unit comprises a current measuring device for measuring the current of the transmitted signal.

The monitoring unit and/or the key comprise a device for detecting the permissibility of the key.

The monitoring unit is suitable for use in a device according to the preceding features.

The key is suitable for use in a device according to the preceding features.

The present disclosure is not restricted to the illustrated and described embodiments. Equivalent amendments and combinations of features of the disclosure are possible even when they are shown or described in different embodiments.

The invention claimed is:

1. An access authorization system comprising:

a monitoring unit comprising:

a first transmitter to transmit a first signal at a first frequency, and a first receiver to receive a response signal; and a key comprising:

a second transmitter to transmit the response signal to the monitoring unit at a second frequency, a second receiver to receive the first signal, and an electronic device configured to determine a signal strength of the first signal in at least one direction; and at least one of an acceleration sensor, a rotation sensor, and a gravity sensor configured to measure a gravity vector associated with an expected motion of one of the monitoring unit and the key, the gravity vector being used to correct the signal strength;

an evaluation device configured to perform a fingerprinting procedure to validate the key, the fingerprinting procedure comprises determining at least one of a distance and a relative position between the key and the monitoring unit based on the response signal.

2. The access authorization system according to claim 1, wherein the one of the first and second receiver comprises a plurality of coils.

3. The access authorization system according to claim 2, further comprising a circuit that is configured to determine a direction of permeation of a magnetic field between at least two of the plurality of coils.

4. The access authorization system according to claim 3, wherein the circuit is further configured to determine a polarization of a transmitted signal.

5. The access authorization system according to claim 3, wherein the circuit is coupled to the second receiver.

6. The access authorization system according to claim 1, further comprising a database to store calibrated data for at least one of the distance and the relative position.

7. The access authorization system according to claim 1, wherein the monitoring unit comprises a current measuring circuit that measures one or more currents.

8. The access authorization system according to claim 1, wherein the evaluation device compares a strength of the first signal with the calibrated measured current to adjust the response signal prior to performing the fingerprinting procedure.

9. A method for accessing an authorization system, the method comprising:

transmitting via a first transmitter first signal at a first frequency from a monitoring unit to a first receiver that is designed to receive a response signal;

transmitting via a second transmitter the response signal to the monitoring unit at a second frequency;

determining a signal strength of the first signal in at least one direction;

measuring a gravity vector associated with an expected motion of one of the first and the second transmitter, the gravity vector being used to correct the signal strength; and performing a fingerprinting procedure to validate a key via an electronic device, the fingerprinting procedure comprising determining at least one of a distance and a relative position between the key and the monitoring unit based on the response signal.

10. The method according to claim 9, further comprising determining a direction of permeation of a magnetic field between at least two coils.

11. The method according to the claim 9, wherein the signal strengths of the first signal are evaluated at least by an absolute value of a magnetic field strength vector in a horizontal plane.

12. The method according to the claim 9, wherein the signal strengths of the first signal are evaluated relatively to each other in one or more directions and angles.

13. The method according to claim 9, wherein the fingerprinting procedure comprises, prior to granting access, comparing the signal strength to an expected signal strength in a permitted access area to determine a validity of the relative position.

14. The method according to claim 9, wherein determining signal strengths of the first signal comprises determining a magnetic field strength vector based on a penetration direction through one or more coils.

15. The method according to claim 9, further comprising evaluating a polarization of one of the first signals and the response signal.

16. The method according to the claim 9, wherein an expected field strength is determined from a calibration measurement.

17. The method according to the claim 9, further comprising determining the one or more currents and comparing one or more currents to one or more calibrated currents.

18. The method according to the claim 9, further comprising detecting at least two of subdivided access areas as part of the fingerprinting procedure prior to validating the key.

19. The method according to the claim 9, further comprising using a tracking procedure that tracks the key within a predetermined area of the monitoring unit and calculates a probability to evaluate a validity of a position of the key.

* * * * *